US010130544B2

(12) United States Patent
Takagi et al.

(10) Patent No.: US 10,130,544 B2
(45) Date of Patent: Nov. 20, 2018

(54) PNEUMATIC MASSAGE APPARATUS FOR TREATMENT OF EDEMA AND METHOD FOR MASSAGING PATIENT'S BODY WITH THE APPARATUS

(71) Applicant: NITTO KOHKI CO., LTD., Tokyo (JP)

(72) Inventors: Norikazu Takagi, Tokyo (JP); Haruki Nakao, Tokyo (JP); Jiro Maegawa, Kanagawa (JP)

(73) Assignee: NITTO KOHKI CO., LTD., Tokyo (JP)

( * ) Notice: Subject to any disclaimer, the term of this patent is extended or adjusted under 35 U.S.C. 154(b) by 797 days.

(21) Appl. No.: 14/627,475

(22) Filed: Feb. 20, 2015

(65) Prior Publication Data

US 2016/0242984 A1 Aug. 25, 2016

(51) Int. Cl.
*A61H 9/00* (2006.01)
*A61H 1/00* (2006.01)

(52) U.S. Cl.
CPC ..... *A61H 1/00* (2013.01); *A61H 9/0078* (2013.01); *A61H 9/00* (2013.01); *A61H 9/0092* (2013.01); *A61H 2209/00* (2013.01)

(58) Field of Classification Search
CPC ..... A61H 9/00; A61H 9/0078; A61H 9/0092; A61H 2209/00
See application file for complete search history.

(56) References Cited

U.S. PATENT DOCUMENTS 4,865,020 A * 9/1989 Bullard ..... A61H 9/0078 601/152
5,109,832 A * 5/1992 Proctor ..... A61H 9/0078 137/624.14

(Continued)

FOREIGN PATENT DOCUMENTS

FR 2 345 992 10/1977
GB 2 313 784 12/1997

(Continued)

OTHER PUBLICATIONS

The European Journal of lymphology and related problems, "XXXIX Congress of European Society of Lymphology", vol. 24, No. 67-68, Valencia (Spain), Jun. 2013.

(Continued)

*Primary Examiner* — Rachel T Sippel
(74) *Attorney, Agent, or Firm* — Wenderoth, Lind & Ponack, L.L.P.

(57) ABSTRACT

A pneumatic massage apparatus making it possible to perform even more efficient drainage is provided.
A pneumatic massage apparatus includes a massage device to be fitted to wrap around at least one of an arm or leg of a patient and having a plurality of air chambers disposed in series in a proximal direction from a distal position of the at least one of an arm and a leg toward the center of the patient's body, and a compressed air control unit configured to supply compressed air into the plurality of air chambers to pressurize them, and discharge compressed air from the plurality air chambers to depressurize them. The compressed (Continued)

air control unit is configured to depressurize the pressurized air chambers in such a manner that, of any pair of mutually adjacent air chambers, a proximal air chamber of the pair first starts to be depressurized, and then a distal air chamber of the pair starts to be depressurized.

10 Claims, 4 Drawing Sheets

(56) References Cited

U.S. PATENT DOCUMENTS

| | | | | |
|---|---|---|---|---|
| 7,771,376 | B2 * | 8/2010 | Roth | A61H 9/0078 128/DIG. 20 |
| 7,846,114 | B2 * | 12/2010 | Webster | A61H 9/0078 601/152 |
| 2013/0237889 | A1 * | 9/2013 | Wright | A61H 9/0078 601/149 |

FOREIGN PATENT DOCUMENTS

| | | |
|---|---|---|
| JP | 58-40137 | 3/1983 |
| JP | 11-19147 | 1/1999 |
| WO | 2009/049103 | 4/2009 |

OTHER PUBLICATIONS

Journal "Artifical Organ", vol. 2, No. 6 (1973), pp. 380-386 (with partial English translation).

Journal "Medical Instrumentation" 42(5), May 1, 1972, pp. 329-330 (with partial English translation).

Academic Journal "Physiotherapy" 35 (Supplement 2), Apr. 20, 2008, p. 764 (with partial English translation).

Extended European Search Report dated Feb. 4, 2015 in corresponding European patent application No. 14182175.1.

* cited by examiner

PNEUMATIC MASSAGE APPARATUS FOR TREATMENT OF EDEMA AND METHOD FOR MASSAGING PATIENT'S BODY WITH THE APPARATUS

TECHNICAL FIELD

The present invention relates to a pneumatic massage apparatus. More particularly, the present invention relates to a pneumatic massage apparatus suitable for use in treatment of various types of edema (swelling), including lymphedema in the legs and arms.

BACKGROUND ART

If lymphatic vessels are depressed in function or occluded by cancer treatment or the like, the lymph fluid does not flow smoothly. Consequently, the lymph fluid, which should normally be absorbed into the lymphatic vessels, may accumulate in spaces in the cellular tissues, resulting in swelling mainly in the arms and legs. Such swelling resulting from obstruction of the circulation of lymph fluid is known as lymphedema. Edema may also occur in the arms and legs owing to some disease in the blood vessels.

Manual lymphatic drainage is known as a method of treating such edema. The manual lymphatic drainage is effective in treating not only lymphedema but also vascular edema. With the manual lymphatic drainage, a body fluid such as lymph fluid accumulated in spaces in the cellular tissues is urged toward normally-functioning lymphatic vessels and blood vessels by massage performed with the human hands, thereby resolving the swelling. The manual lymphatic drainage needs to be performed almost daily, which is a heavy burden whether the patient oneself performs the massage or a nurse or the like massages the patient.

To lighten the load of carrying out manual lymphatic drainage, it is becoming common practice to perform lymphatic drainage using a pneumatic massage apparatus as an auxiliary of manual lymphatic drainage. A pneumatic massage apparatus used for this purpose has a plurality of air chambers disposed in series in a proximal direction from a distal position of an arm or a leg of a patient's body toward the center of the patient's body. Each air chamber is inflated with compressed air supplied thereinto to compress the patient's arm or leg by pneumatic pressure, thereby performing massage. Basically, a body fluid such as lymph fluid needs to be urged from the distal part of a patient's arm or leg toward the center of the patient's body. Therefore, usually, the air chambers are pressurized sequentially from a distal end air chamber located at the periphery side toward successively proximal air chambers to promote the flow of body fluid by the action of compressing the patient's arm or leg during pressurization (see Non-Patent Document 1).

CITATION LIST

Non-Patent Document

Catalog "Physical Medomer PM-8000", Nitto Kohki Co., Ltd. (Tokyo, JP)

SUMMARY OF INVENTION

Technical Problem

The above-described conventional pneumatic massage apparatus offers certain advantageous effects as an auxiliary of manual lymphatic drainage. It is, however, desirable to be able to promote the flow of body fluid even more efficiently. The present invention has been made in view of these circumstances, and provides a pneumatic massage apparatus making it possible to perform even more efficient drainage.

Solution to Problem

That is, the present invention provides a pneumatic massage apparatus including a massage device to be fitted to wrap around at least one of an arm or leg of a patient and having a plurality of air chambers disposed in series in a proximal direction from a distal position of the at least one of an arm and a leg toward the center of the patient's body when the massage device is fitted around the at least one of an arm and a leg, and a compressed air control unit configured to supply compressed air into the plurality of air chambers to pressurize them, and discharge compressed air from the plurality air chambers to depressurize them. The compressed air control unit is configured to depressurize the pressurized air chambers in such a manner that, of any pair of mutually adjacent air chambers, a proximal air chamber of the pair first starts to be depressurized, and then a distal air chamber of the pair starts to be depressurized.

In the pneumatic massage apparatus of the present invention, when the pressurized air chambers are to be depressurized, a proximal (closer to the center of the patient's body) air chamber of any pair of mutually adjacent air chambers first starts to be depressurized. Therefore, at the time when the depressurization of the proximal air chamber is started, the distal (closer to the periphery of the patient's body) air chamber is still in a pressurized state. Consequently, a pressure difference is produced between a patient's body part having been compressed by the proximal air chamber until depressurization thereof and another patient's body part being compressed by the distal air chamber still being pressurized. As a result, the body fluid flows in the proximal direction from the distal body part toward the proximal body part. In this way, it is possible to urge the body fluid to flow in the proximal direction not only during pressurization but also during depressurization and hence possible to perform even more efficient drainage. As has been stated above, with the conventional pneumatic massage apparatus, the air chambers are pressurized sequentially from a distal end air chamber located at the periphery side toward successively proximal air chambers to promote the flow of body fluid mainly by the action of compressing the patient's arm or leg during pressurization. Further, in the conventional pneumatic massage apparatus, the air chambers are sequentially depressurized from the distal air chamber pressurized first, or alternatively, all the air chambers are simultaneously depressurized. Thus, the depressurization of the massage chambers is performed solely to repeatedly promote the flow of body fluid by pressurization. The pneumatic massage apparatus according to the present invention is, as has been stated above, configured to urge the body fluid to flow toward the center of the patient's body also by the depressurization of the air chambers.

Preferably, the compressed air control unit may be configured to start depressurizing at least one of the pressurized air chambers except a distal end air chamber disposed at the distal-most position of the pressurized air chambers before depressurization of the distal end air chamber.

Specifically, the compressed air control unit may be configured such that, when the pressurized air chambers are numbered sequentially in the proximal direction so that the distal end air chamber is given number one, the even-numbered air chambers first start to be depressurized in descending order of the given numbers, and then the odd-numbered air chambers start to be depressurized in descending order of the given numbers.

Alternatively, the compressed air control unit may be configured such that, when the pressurized air chambers are numbered sequentially in the proximal direction so that the distal end air chamber is given number one, the odd-numbered air chambers first start to be depressurized in descending order of the given numbers, and then the even-numbered air chambers start to be depressurized in descending order of the given numbers.

Alternatively, the compressed air control unit may be configured such that, when the pressurized air chambers are numbered sequentially in the proximal direction so that the distal end air chamber is given number one, the air chambers start to be depressurized in descending order of the given numbers.

The results of exhaustive studies conducted by the present inventors have proved that particularly efficient drainage can be performed by the above-described depressurization patterns.

Specifically, the compressed air control unit may be configured such that, when the air chambers are numbered sequentially in the proximal direction so that the distal end air chamber is given number one, the air chambers start to be pressurized in ascending order of the given numbers.

The compressed air control unit may be configured to start pressurizing the plurality of air chambers simultaneously.

Preferably, the plurality of air chambers may be disposed so that the mutually adjacent air chambers overlap each other.

Because the mutually adjacent air chambers are disposed to overlap each other, the area of the patient's body that is not to be pressurized by the air chambers reduces, and pressure can be applied all over the arm or leg. It is therefore possible to perform even more efficient drainage.

Preferably, the compressed air control unit may further be configured to maintain a pressurized state of each air chamber for a predetermined period of time after completion of pressurization of the air chamber by the compressed air control unit.

An embodiment of a pneumatic massage apparatus according to the present invention will be explained below with reference to the accompanying drawings.

The present invention further provides a method for massaging at least one of an arm and a leg of a patient. The method includes a step of providing a massage device to be fitted to wrap around at least one of an arm and a leg of a patient and having a plurality of air chambers disposed in series in a proximal direction from a distal position of the at least one of the at least one of an arm and a leg toward a center of a body of the patient when the massage device is fitted around the at least one of an arm and a leg; and a compressed air control unit configured to supply compressed air into the plurality of air chambers to pressurize them, and discharge compressed air from the plurality air chambers to depressurize them. The method further includes steps of wrapping the massage device around the at least one of an arm and a leg; pressurizing the air chambers with the compressed air control unit; and depressurizing the pressurized air chambers with the compressed air control unit in such a manner that, of any pair of mutually adjacent ones of the air chambers, a proximal air chamber of the pair first starts to be depressurized, and then a distal air chamber of the pair starts to be depressurized.

DESCRIPTION OF EMBODIMENTS

Figure 1:
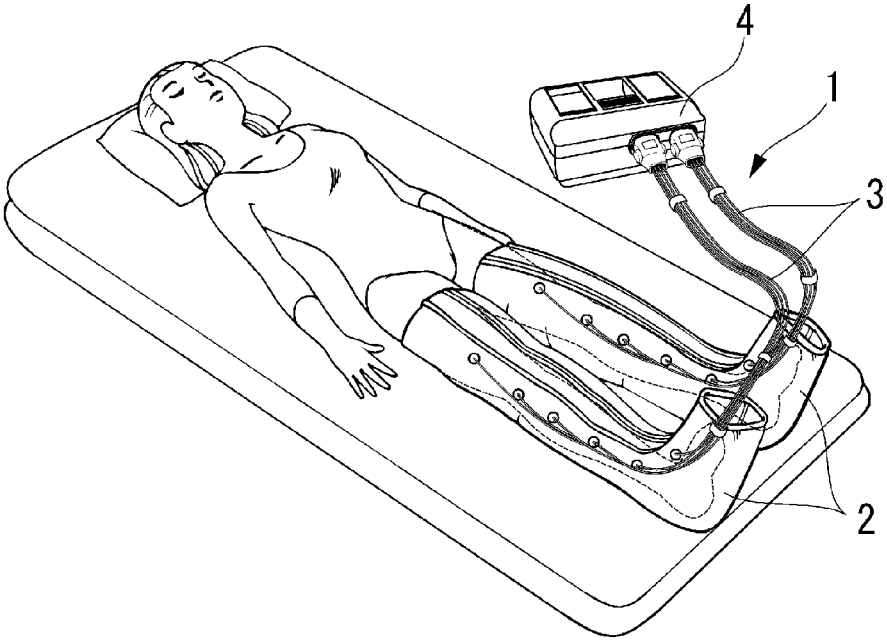
FIG. 1 is a general view showing a pneumatic massage apparatus according to the present invention.
Figure 2:
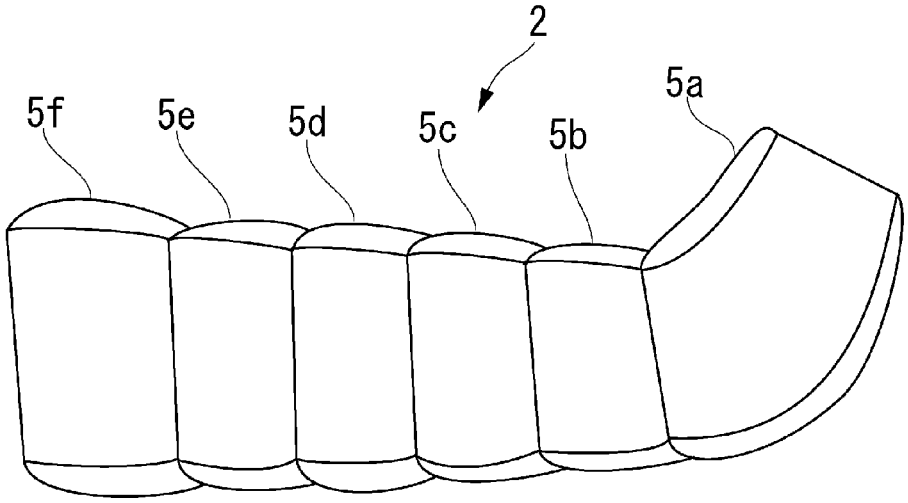
FIG. 2 is an illustration of a massage device of the pneumatic massage apparatus shown in FIG. 1.

As shown in FIG. 1, a pneumatic massage apparatus 1 according to an embodiment of the present invention has tubular massage devices 2 to be fitted to wrap around the legs of a patient, and a compressed air control unit 4 connected to the massage devices 2 through air tubes 3. Each massage device 2 has, as shown in FIG. 2, first to sixth air chambers 5*a*-5*f* arranged in series from a periphery-side portion of the massage device 2 covering a patient's foot from the tow to the heel to a center-side portion of the massage device 2 covering the patient's thigh. The six air chambers 5*a*-5*f* are disposed so that the mutually adjacent air chambers overlap each other. The air tubes 3 respectively connect between the air chambers 5*a*-5*f* of each massage device 2 and the compressed air control unit 4. The compressed air control unit 4 is provided therein with an air pump (not shown) delivering compressed air, six electromagnetic valves (not shown) disposed between the air pump and the air tubes 3, respectively, six pressure sensors (not shown) for measuring the pressure in the air chambers 5*a*-5*f*, and a control circuit (not shown) controlling the drive of the six electromagnetic valves. Each of the electromagnetic valves is a three-way valve having a first opening communicating with the air pump, a second opening communicating with the associated air chamber through the associated air tube 3, and a third opening communicating with the atmosphere. When the electromagnetic valve is in an OFF state, the first opening is closed, and the second and third openings are communicated with each other. Thus, the electromagnetic valve is in a compressed air discharge state. When the electromagnetic valve is in an ON state, the third opening is closed, and the first and second openings are communicated with each other. Thus, the electromagnetic valve is in a compressed air supply state. That is, when the electromagnetic valve is turned ON by the control circuit while the air pump is operating, the electromagnetic valve is brought into a compressed air supply state, so that compressed air from the air pump is supplied into the associated air chamber. Consequently, the air chamber is pressurized and thus inflated. When turned OFF, the electromagnetic valve is brought into a compressed air discharge state, so that the compressed air in the associated air chamber is discharged into the atmosphere. Consequently, the air chamber is depressurized and thus deflated.

The operating sequence of the electromagnetic valves, i.e. the order in which the air chambers 5*a*-5*f* are pressurized and depressurized, can be set as desired with the control circuit. In the pneumatic massage apparatus 1, the electromagnetic valves are turned ON in a sequence set by a pressurization program of the control circuit, and after completion of pressurization of all the air chambers, each air chamber is allowed to maintain the pressurized state for a predetermined period of time (5 seconds) by a pressurized state maintaining program. Thereafter, the electromagnetic valves are turned OFF in a sequence set by a depressurization program, and thus all the air chambers 5*a*-5*f* are depressurized. After completion of depressurization of all the air chambers 5*a*-5*f*, the pressurization program starts again. In this way, pressurization and depressurization are performed in sequences similar to the above. This cycle is repeated thereafter.

Typical pressurization patterns used in the pneumatic massage apparatus 1 include a first pressurization pattern in which all the electromagnetic valves are simultaneously turned ON to pressurize all the air chambers 5*a*-5*f* simultaneously, and a second pressurization pattern in which the first to sixth electromagnetic valves are sequentially turned ON to start pressurizing the air chambers sequentially in the proximal direction from the first air chamber, which is the distal-most air chamber, to the sixth air chamber, which is the proximal-most air chamber. However, pressurization patterns usable in the present invention are not limited to those described above. The first to sixth electromagnetic valves may be driven to pressurize the air chambers 5*a*-5*f* in any sequence.

Depressurization patterns used in the pneumatic massage apparatus 1 are, basically, such that, of any pair of mutually adjacent air chambers, a proximal air chamber of the pair first starts to be depressurized, and then a distal air chamber of the pair starts to be depressurized. By performing depressurization in this way, a pressure gradient is produced between a patient's body part having been compressed by the proximal air chamber until depressurization thereof and another patient's body part being compressed by the distal air chamber. Consequently, it is possible to urge the body fluid to flow from the body part being compressed by the distal air chamber toward the body part having been compressed by the proximal air chamber until depressurization thereof. Typical depressurization patterns used in the pneumatic massage apparatus 1 include first, second and third depressurization patterns. In the first depressurization pattern, the sixth air chamber 5*f* first starts to be depressurized, and thereafter, the fourth air chamber 5*d*, the second air chamber 5*b*, the fifth air chamber 5*e*, the third air chamber 5*c*, and the first air chamber 5*a* start to be depressurized in the order mentioned. In the second depressurization pattern, the fifth air chamber 5*e* first starts to be depressurized, and thereafter, the third air chamber 5*c*, the first air chamber 5*a*, the sixth air chamber 5*f*, the fourth air chamber 5*d*, and the second air chamber 5*b* start to be depressurized in the order mentioned. In the third depressurization pattern, the air chambers start to be depressurized sequentially in the order in which the air chambers are arranged in the distal direction, i.e. from the sixth air chamber 5*f* to the first air chamber 5*a*. It should, however, be noted that depressurization patterns usable in the present invention are not limited to the above-described three depressurization patterns, and that the present invention may use any depressurization pattern in which depressurization of each of the air chambers 5*a*-5*f* is performed so that the pressure applied to the patient's body decreases from the distal side toward the proximal side.

Figure 3:
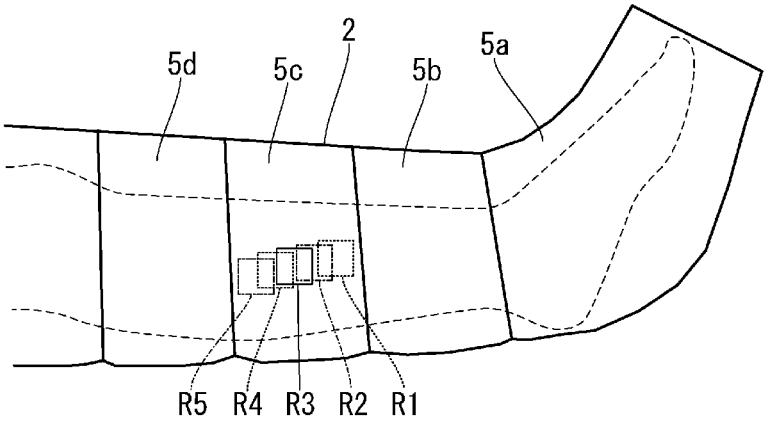
FIG. 3 is a schematic view showing an outline of an experiment.

To verify the effects of the pneumatic massage apparatus 1 as used for lymphatic drainage, we observed the flow of lymph fluid during massage performed using the pneumatic massage apparatus 1 by ICG (Indo-Cyanine Green) fluorescence imaging. The ICG fluorescence imaging is a technique in which ICG that emits infrared fluorescence having a wavelength of 830 nm when excited with infrared light of 760 nm in wavelength is intracutaneously injected into a patient's body, and fluorescence that the ICG emits when irradiated with infrared excitation light from the outside of the patient's body is observed with an infrared observation camera, thereby observing the ICG flowing with the lymph fluid to inspect the flow of lymph fluid and to identify the position of lymphatic vessels. Infrared light, which has a long wavelength, can penetrate biological tissues relatively easily. Therefore, the ICG fluorescence technique can observe the flow of lymph fluid deep under the skin. In this experiment, a transparent massage device 2 having six air chambers 5*a*-5*f* was fitted around a subject's leg as shown in FIG. 3, and ICG was intracutaneously injected between each pair of subject's toes. Thereafter, massage using the pneumatic massage apparatus 1 was started, and the flow of ICG was observed during the massage with an infrared observation camera while irradiating an area around the subject's calf with infrared excitation light. Specifically, the observation area observed with the infrared observation camera was provided with five measurement regions R1-R5 as shown in FIG. 3. An average value of fluorescence intensity in each of the measurement regions R1-R5 was calculated every 0.2 seconds, and the magnitude of the flow of ICG, i.e. the flow of lymph fluid, was evaluated from the change of the average fluorescence intensity.

Figure 4:
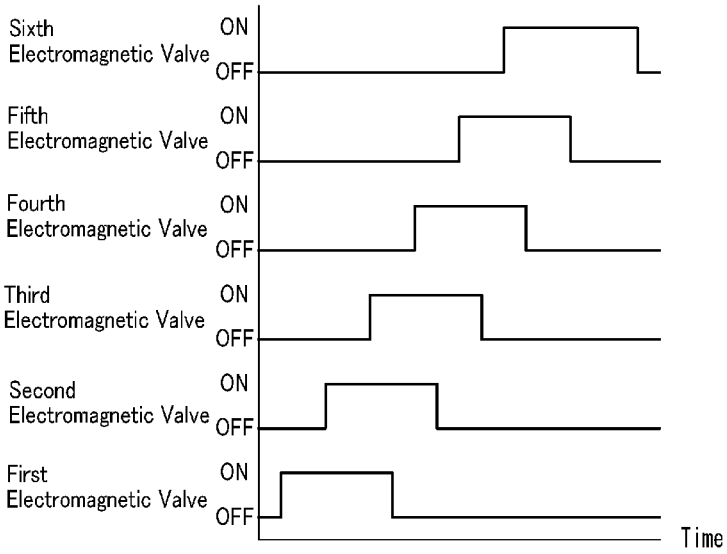
FIG. 4 is a diagram showing a driving sequence of electromagnetic valves of a conventional pneumatic massage apparatus.

The first experiment was carried out to verify the effects of the conventional pneumatic massage apparatus. In the first experiment, as shown in FIG. 4, the first to sixth electromagnetic valves corresponding to the first to sixth air chambers, respectively, were sequentially turned ON from the first electromagnetic valve to the sixth electromagnetic valve, and while doing so, the first to sixth electromagnetic valves were sequentially turned OFF in such a manner that the first electromagnetic valve was first turned OFF at a timing after the third electromagnetic valve was turned ON, and so forth. Consequently, the air chambers were pressurized sequentially in the order in which the first to sixth air chambers were arranged in the proximal direction. When the third air chamber started to be pressurized, the first air chamber, which was the distal-most air chamber, first started to be depressurized, and then the second to sixth air chambers were depressurized sequentially. The pressure in each air chamber during pressurization was 8 kPa.

Figure 5:
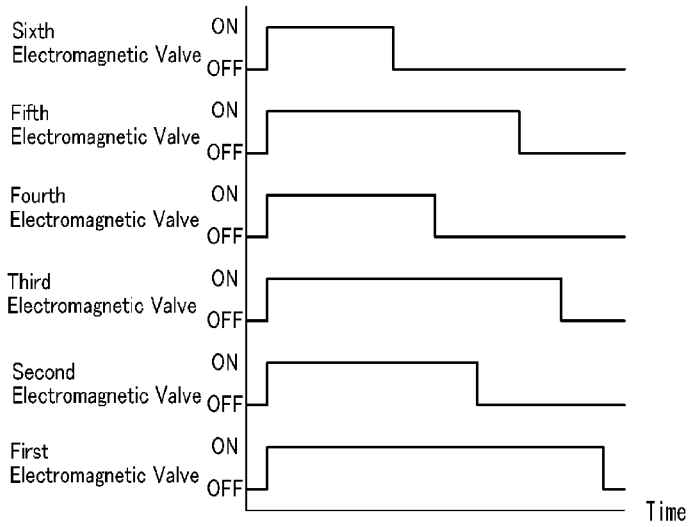
FIG. 5 is a diagram showing a driving sequence of electromagnetic valves of the pneumatic massage apparatus according to the present invention.

The second experiment was carried out to verify the effects of the pneumatic massage apparatus 1 according to the present invention. In the second experiment, the above-described first pressurization pattern and first depressurization pattern were combined, as shown in FIG. 5, to present a typical example of pressurization-depressurization patterns usable in the present invention. That is, the first to sixth electromagnetic valves were controlled as follows. The six air chambers 5*a*-5*f* were simultaneously pressurized, and after the pressurized state was maintained for 5 seconds, the sixth air chamber 5*f* started to be depressurized, and thereafter, the fourth air chamber 5*d*, the second air chamber 5*b*, the fifth air chamber 5*e*, the third air chamber 5*c*, and the first air chamber 5*a* started to be depressurized sequentially in the order mentioned. The pressure in each of the air chambers 5*a*-5*f* during pressurization was 8 kPa, as in the case of the first experiment.

Figure 6:
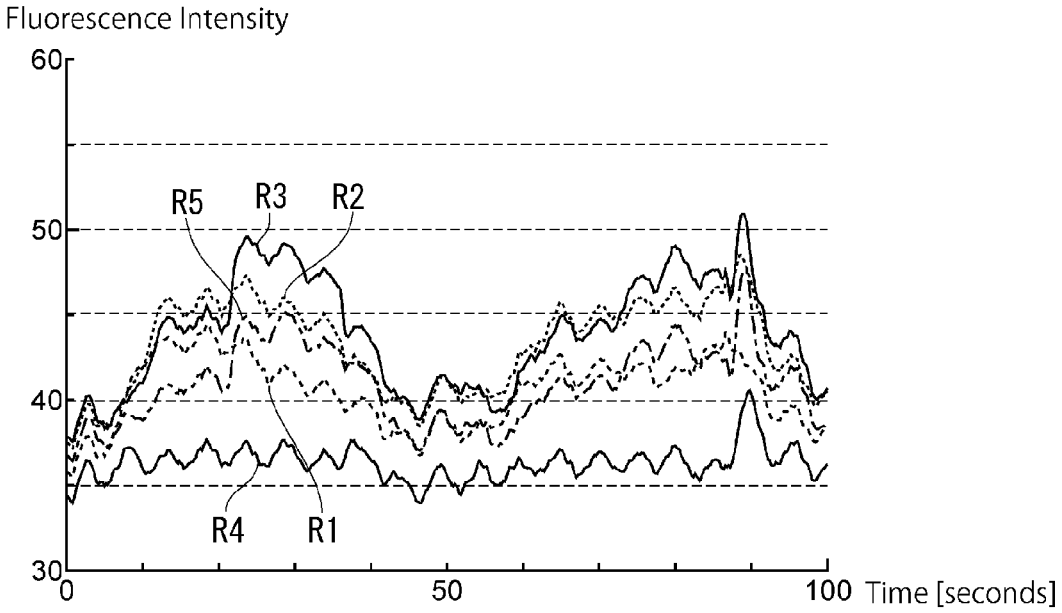
FIG. 6 is a graph showing the results of a first experiment.
Figure 7:
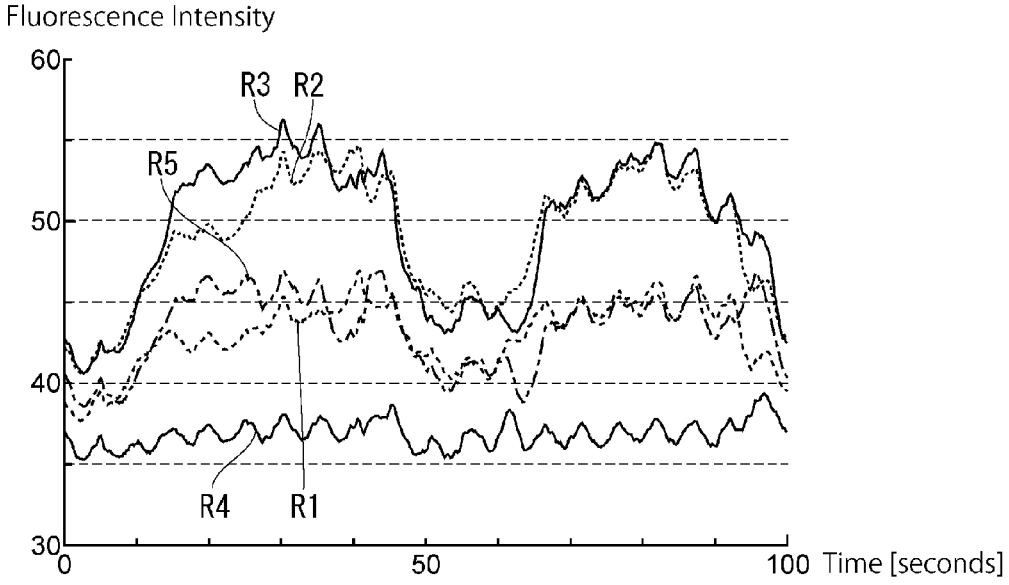
FIG. 7 is a graph showing the results of a second experiment.

FIGS. 6 and 7 show the results of the first and second experiments, respectively. FIGS. 6 and 7 show the changes of the average fluorescence intensity in the first to fifth measurement regions R1-R5 in a period of time corresponding to about 2 cycles of each pressurization-depressurization pattern. In the graphs of FIGS. 6 and 7, at points where there is an increase in fluorescence intensity, the air chambers 5*a*-5*f* were pressurized, and at points where there is a decrease in fluorescence intensity, the air chambers 5*a*-5*f* were depressurized. It will be understood that the amount of change in fluorescence intensity of ICG during massage using the pneumatic massage apparatus 1 of the present invention, which is shown in FIG. 7, is larger than the amount of change in fluorescence intensity of ICG during massage using the conventional pneumatic massage apparatus, which is shown in FIG. 6. The amount of change in fluorescence intensity is correlated with the change in amount of ICG. Therefore, it is considered from the above-described results that a larger amount of ICG passed through the measurement regions R1-R5 in the second experiment than in the first experiment. In other words, it is considered that a larger amount of lymph fluid passed through the measurement regions R1-R5 in the second experiment using the present invention. In addition, the fluorescence intensity decreases more sharply, particularly, during depressurization in the second experiment, which is shown in FIG. 7, and it is inferred from the results of the second experiment that the lymph fluid flowed more rapidly in the second experiment. These experimental results suggest that the massage using the pneumatic massage apparatus 1 according to the present invention allows a larger amount of lymph fluid to flow more rapidly than the massage using the conventional pneumatic massage apparatus.

According to the present invention, the order in which the air chambers 5*a*-5*f* are depressurized, in particular, is appropriately set to form inside the patient's body such a pressure gradient that the pressure decreases in the proximal direction from the periphery toward the center of the patient's body, thereby urging the lymph fluid to flow not only during pressurization but also during depressurization. Although the first to third depressurization patterns have been shown above specifically as examples of a depressurization pattern for forming the above-described pressure gradient, other depressurization patterns may also be used to realize the present invention. Examples of other usable depressurization patterns will be shown below, together with the above-described first to third depressurization patterns. It should, however, be noted that depressurization patterns usable in the present invention are not limited to those shown below.

TABLE 1

| | |
|---|---|
| First Depressurization Pattern | 6 → 4 → 2 → 5 → 3 → 1 |
| Second Depressurization Pattern | 5 → 3 → 1 → 6 → 4 → 2 |
| Third Depressurization Pattern | 6 → 5 → 4 → 3 → 2 → 1 |
| Fourth Depressurization Pattern | 6 → 3 → 5 → 2 → 4 → 1 |
| Fifth Depressurization Pattern | (6, 4, 2) → (5, 3, 1) |
| Sixth Depressurization Pattern | (5, 3, 1) → (6, 4, 2) |
| Seventh Depressurization Pattern | (6, 5) → (4, 3) → (2, 1) |
| Eighth Depressurization Pattern | (6, 5, 4) → (3, 2, 1) |
| Ninth Depressurization Pattern | (6, 3) → (5, 2) → (4, 1) |

In Table 1, each arrow means that, after an air chamber designated by the number on the left side of the arrow has started to be depressurized, an air chamber designated by the number on the right side of the arrow starts to be depressurized. Air chambers designated by the numbers in each set of parentheses simultaneously start to be depressurized. It should be noted that the timing of starting depressurization may be either of the following: a next air chamber may start to be depressurized after completion of depressurization of the preceding air chamber; a next air chamber may start to be depressurized in the middle of depressurization of the preceding air chamber.

Although all the air chambers 5*a*-5*f* of the massage device 2 are used in the above-described pressurization-depressurization patterns, only necessary air chambers may be used according to each particular situation. For example, when the patient has edema only in the calf portion and drainage of his or her thigh is unnecessary, only the first to fourth air chambers 5*a*-5*d* may be used. Further, the pressurizing force may be changed appropriately in accordance with the severity of edema. It is also possible to set a different pressure value for each of the air chambers 5*a*-5*f*. These conditions can be changed appropriately in accordance with the condition of the patient.

Although in the foregoing embodiment each massage device 2 is provided with six air chambers 5*a*-5*f*, the number and size of air chambers may be changed appropriately. Lymph flow in vivo is a stream of lymph fluid flowing in small amounts through thin lymphatic vessels having valve structures; therefore, lymph fluid cannot be allowed to flow over a long distance at a time. Accordingly, it is an effective way to depressurize an air chamber closer to the center of the patient's body by a distance of from several centimeters to 20 centimeters at the most from a patient's body portion from which the lymph fluid is desired to be drained. For this reason, when the pneumatic massage apparatus of the present invention is used for treatment of lymphedema, the number of air chambers may be increased to 8 or 12, with the size of each air chamber being reduced. With this structure, lymphatic drainage may be able to be performed even more efficiently. Alternatively, the massage device 2 may have a reduced number of air chambers, i.e. four air chambers, to form a compact massage device for performing local drainage. Although in the foregoing embodiment the massage device 2 is for massaging a leg, the massage device 2 may also be constructed to massage an arm by modifying the configuration.

The invention claimed is:

1. A pneumatic massage apparatus comprising:

a massage device to be fitted to wrap around at least one of an arm and a leg of a patient and having a plurality of air chambers disposed in series in a proximal direction from a distal position of the at least one of an arm and a leg toward a center of a body of the patient when the massage device is fitted around the at least one of an arm and a leg; and a compressed air control unit configured to supply compressed air into the plurality of air chambers to pressurize the plurality of air chambers, and discharge compressed air from the plurality air chambers to depressurize the plurality of air chambers, the compressed air control unit having a control circuit and a pressurization means configured to pressurize each of the plurality of air chambers by supplying compressed air into each of the plurality of air chambers, and a depressurization means configured to depressurize each of the plurality of air chambers having been supplied compressed air by the compressed air control unit in such a manner that, when after all the plurality of air chambers have been supplied compressed air by the compressed air control unit, the plurality of air chambers being numbered sequentially in the proximal direction so that a distal end air chamber disposed at a distal-most position of the air chambers is given number one, even-numbered air chambers first start to be depressurized in descending order of numbers given thereto, and then odd-numbered air chambers start to be depressurized in descending order of numbers given thereto.

2. The pneumatic massage apparatus of claim 1, wherein the compressed air control unit is configured such that the plurality of air chambers start to be pressurized in ascending order of numbers given thereto.

3. The pneumatic massage apparatus of claim 2, wherein the compressed air control unit is configured to maintain a pressurized state of each of the plurality of air chambers having been supplied compressed air by the compressed air control unit for a predetermined period of time after all the plurality of air chambers have been supplied compressed air by the compressed air control unit.

4. The pneumatic massage apparatus of claim 1, wherein the compressed air control unit is configured to start pressurizing the plurality of air chambers simultaneously.

5. The pneumatic massage apparatus of claim 4, wherein the compressed air control unit is configured to maintain a pressurized state of each of the plurality of air chambers having been supplied compressed air by the compressed air control unit for a predetermined period of time after all the plurality of air chambers have been supplied compressed air by the compressed air control unit.

6. The pneumatic massage apparatus of claim 1, wherein the compressed air control unit is configured to maintain a pressurized state of each of the plurality of air chambers having been supplied compressed air by the compressed air control unit for a predetermined period of time after all the plurality of air chambers have been supplied compressed air by the compressed air control unit.

7. A pneumatic massage apparatus comprising:

a massage device to be fitted to wrap around at least one of an arm and a leg of a patient and having a plurality of air chambers disposed in series in a proximal direction from a distal position of the at least one of an arm and a leg toward a center of a body of the patient when the massage device is fitted around the at least one of an arm and a leg; and a compressed air control unit configured to supply compressed air into the plurality of air chambers to pressurize the plurality of air chambers, and discharge compressed air from the plurality air chambers to depressurize the plurality of air chambers, the compressed air control unit having a control circuit and a pressurization means configured to pressurize each of the plurality of air chambers by supplying compressed air into each of the plurality of air chambers, and a depressurization means configured to depressurize each of the plurality of air chambers having been supplied compressed air by the compressed air control unit in such a manner that, when after all the plurality of air chambers have been supplied compressed air by the compressed air control unit, the plurality of air chambers being numbered sequentially in the proximal direction so that a distal end air chamber disposed at a distal-most position of the air chambers is given number one, odd-numbered air chambers first start to be depressurized in descending order of numbers given thereto, and then even-numbered air chambers start to be depressurized in descending order of numbers given thereto.

8. The pneumatic massage apparatus of claim 7, wherein the compressed air control unit is configured such that the plurality of air chambers start to be pressurized in ascending order of numbers given thereto.

9. The pneumatic massage apparatus of claim 7, wherein the compressed air control unit is configured to start pressurizing the plurality of air chambers simultaneously.

10. The pneumatic massage apparatus of claim 7, wherein the compressed air control unit is configured to maintain a pressurized state of each of the plurality of air chambers having been supplied compressed air by the compressed air control unit for a predetermined period of time after all the plurality of air chambers have been supplied compressed air by the compressed air control unit.

* * * * *